United States Patent [19]

Schoenwald et al.

[11] Patent Number: 4,992,028

[45] Date of Patent: Feb. 12, 1991

[54] LIQUID RING PUMP

[75] Inventors: Siegfried Schoenwald, Bad Neustadt/S; Robert Seufert, Bastheim, both of Fed. Rep. of Germany

[73] Assignee: Siemens Aktiengesellschaft, Berlin & Munich, Fed. Rep. of Germany

[21] Appl. No.: 429,765

[22] Filed: Oct. 31, 1989

[30] Foreign Application Priority Data

Nov. 7, 1988 [EP] European Pat. Off. ..... 88118520

[51] Int. Cl.[5] ..... F04C 19/00

[52] U.S. Cl. ..... 417/68

[58] Field of Search ..... 417/468, 69

[56] References Cited

U.S. PATENT DOCUMENTS

| | | | |
|---|---|---|---|
| 1,897,199 | 2/1933 | Kenney . | |
| 3,180,449 | 4/1965 | Cuneo | 181/52 |
| 3,884,596 | 5/1975 | Hoffmeister | 417/68 |
| 4,565,498 | 1/1986 | Schmid et al. | 417/68 |
| 4,610,602 | 9/1986 | Schmid et al. | 417/68 |
| 4,636,154 | 1/1987 | Sugiyama et al. | 418/97 |
| 4,710,105 | 12/1987 | Segebrecht et al. | 417/68 |
| 4,755,107 | 7/1988 | Trimborn | 417/68 |

FOREIGN PATENT DOCUMENTS 0138182 3/1988 European Pat. Off. .

*Primary Examiner*—Michael Koczo
*Assistant Examiner*—John A. Savio, III
*Attorney, Agent, or Firm*—Kenyon & Kenyon

[57] ABSTRACT

A liquid ring pump includes an impeller rotatably supported in an open ended cup-shaped housing. The impeller includes blades which are spaced to form pockets therebetween so that a certain amount of liquid may be maintained in the pockets to compress gas introduced beneath the liquid. A control disk having an inlet port and at least one outlet port is positioned adjacent to the impeller. A cup-shaped cover having intake and pressure connections and a partition wall therebetween covers the open end of the housing. The control disk and cup-shaped cover together with the partition wall form a suction chamber in fluid communication with the intake connection and a surge chamber in fluid communication with the pressure connection. Intake gas flows from the intake connection into the suction chamber and then through the control disk inlet port into at least one of the impeller blade pockets. After the impeller rotates, the then compressed gas flows through a control disk outlet port into the surge chamber, and then to the outlet opening of the pressure connection. Noise originating at the control disk outlet port(s) is dampened by at least one baffle disposed in the surge chamber which diverts the portion of the sealing liquid expelled together with the compressed gas to follow a course that at least at one location intersects the course of the compressed gas flowing through the surge chamber toward the outlet opening of the pressure connection.

6 Claims, 1 Drawing Sheet

LIQUID RING PUMP

BACKGROUND OF THE INVENTION

The present invention relates to pumps generally, and more specifically to a liquid ring pump having a noise damping mechanism.

Liquid ring pumps typically comprise an open ended cup-shaped housing, an impeller rotatably supported in the housing adjacent a control disk and a cup-shaped member covering the open end of the housing. The impeller includes blades which in conjunction with surfaces thereabout form blade pockets or cells. A certain amount of liquid is trapped between adjacent blades in these pockets or cells. As the impeller turns, the liquid in a respective pocket Or space between adjacent blades moves in and out due to the impeller being eccentrically mounted in the pump housing. This creates, in effect, a liquid piston as the blades drive the captive ring of liquid around the inside of the casing. The cup-shaped cover member includes a conduit-like intake connection having an inlet opening and a conduit-like pressure connection having an outlet opening. These connections are associated with the cup-shaped cover member so that the inlet and outlet openings provide fluid communication between the intake and pressure connections, respectively, and the interior of the cup-shaped member facing the pump housing. The cup-shaped member further includes a partition wall which extends toward the cup-shaped housing and which is disposed between the inlet opening and outlet opening of the abovementioned connections. A control disk is arranged between the housing and the cup-shaped member so that the control disk and cup-shaped member together with the partition wall form a suction chamber in fluid communication with the intake conduit via the inlet opening and a surge chamber in fluid communication with the pressure conduit via the outlet opening. The control disk includes an inlet port and at least one outlet port formed therethrough, wherein the inlet port provides fluid communication between the suction chamber and at least one blade pocket and the outlet opening provides fluid communication between at least one blade pocket and the surge chamber. Accordingly, intake fluid, such as gas, is compressed within the pockets before the pockets line up with the outlet opening(s) prior to discharge.

Such a liquid ring pump is disclosed in European Patent No. 138,182. However, these liquid ring pumps present a problem in that they generate a very disturbing, roaring noise, especially at average intake pressures. This noise originates at the outlet opening(s) or orifice(s) formed in the control disk, through which the sealed-in and compressed gas is rhythmically exhausted. Then the noise is transmitted to the outside of the pump via the pressure conduit or external outlet connections. Thus, there is a need to develop a liquid ring pump which minimizes such noise.

SUMMARY OF THE INVENTION

The present invention is directed to a liquid ring pump that avoids the above-mentioned problems and disadvantages of the prior art by providing a liquid ring pump with a noise damping device that considerably reduces noise transmitted to the outside of the pump. The invention accomplishes this goal by providing a device for diverting fluid flow in the surge chamber of a liquid ring pump having an impeller rotatably supported in an open ended cup-shaped housing. The impeller includes blades which are spaced so that blade pockets are formed between adjacent blades to contain a certain amount of sealing liquid. A cup-shaped member covers the open end of the housing and includes an intake conduit having an inlet opening and a pressure conduit having an outlet opening. These openings provide fluid communication between the intake and pressure conduits and the interior of the cup-shaped member facing the housing. The cup-shaped member further includes at least one wall disposed between the inlet opening and outlet opening and extending toward the cup-shaped housing. A control disk is arranged between the cup-shaped housing and the cup-shaped cover member such that the control disk and cup-shaped cover member together with the at least one wall form a suction chamber in fluid communication with the intake conduit via the inlet opening and a surge chamber in fluid communication with the pressure conduit via the outlet opening. The control disk includes an inlet port and at least One outlet port formed therethrough. The inlet port provides fluid communication between the suction chamber and at least one of the blade pockets, while the outlet port provides fluid communication between at least one of the blade pockets and the surge chamber. The diverting device is disposed within the surge chamber between the outlet port of the control disk and the outlet opening of the pressure conduit for diverting fluid flowing in the surge chamber from the outlet port toward the outlet opening of the pressure conduit to follow a path in the axial direction. Thus, the device diverts the portion of the sealing liquid, which is expelled with compressed gas into the surge chamber, to follow a path which intersects the path of the compressed gas. By diverting the sealing liquid as described, a finely dispersed liquid veil is produced, which has a powerful noise damping effect.

The sealing liquid is diverted in the desired manner by one or more baffles which extend axially in the surge chamber. This guarantees that the discharged gas does not form any passageway for noise transmission, due to such a passageway not being adequately filled with a liquid veil.

Furthermore, unwanted throttling losses in the compressed gas are kept to a minimum, because the gas is diverted to the smallest extent possible. This is achieved in that the baffle only partially covers the outlet opening of the pressure connection in the axial direction, or in that an arrangement of more than one baffle is provided, wherein the baffles do not overlap in the axial direction. Thus, the straightest possible path between the outlet port of the control disk and the outlet opening of the pressure connection remains essentially unobstructed by the baffle(s) so that the gas particles may effectively travel therealong.

From a production engineering standpoint, it is advantageous if one baffle is molded with the housing cover on the inner wall thereof, while the other baffle is mounted as a separate component on the housing cover. In this manner, undercuts are avoided, which otherwise would make it more expensive to manufacture the housing cover using the casting process. The other baffle, which is separately mounted, has a lamellar design and is mounted simply by inserting it into retention slits extending in the axial direction on the housing cover. This additional baffle may be clamped in the retention slits, because it is made of a flexible plastic strip having a surface length slightly greater than the rectilinear distance between the retention slits. As a result of such relative dimensions, the plastic strip must be somewhat bent when it is inserted in the retention slits. Due to the thereby developing tension forces, it is held against the surface areas of the retention slits and releasably secured thereby.

DETAILED DESCRIPTION

Figure 2:
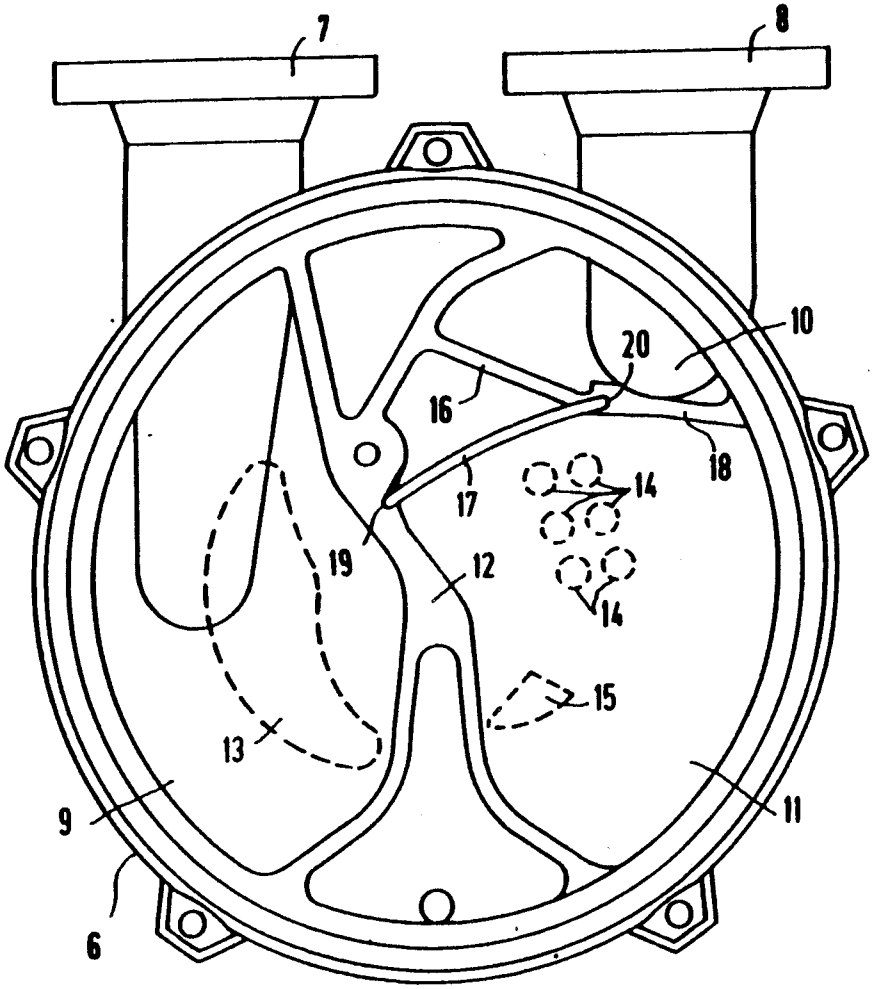
FIG. 2 is an end view of the housing cover illustrated in FIG. 1 showing the structure which faces the pump housing.

Referring to the drawings in detail, wherein like numerals indicate like elements, a liquid ring pump in accordance with the principles of the present invention is shown. The pump includes open ended pump housing 1 which may be configured to resemble a cup-shaped shell. The pump also includes pump impeller 3 which is provided with blades 2, rotatably supported in pump housing 1 and propelled by way of shaft extension 4 protruding out of pump housing 1. The impeller blades in conjunction with the surfaces thereabout form blade pockets or cells. A certain amount of liquid is trapped between adjacent blades in these pockets or cells so that as the impeller turns, the liquid in a respective pocket or space between adjacent blades moves in and out due to, for example, the impeller being eccentrically mounted in the pump housing. This creates, in effect, a liquid piston as the blades drive the captive ring of liquid around the inside of the casing. Control disk 5 is arranged on the open end or front side of pump housing 1 adjacent impeller 3 and between pump housing 1 and cup-shaped housing cover 6. Thus, control disk 5 and housing cover 6 seal pump housing 1 on this side.

Referring to FIG. 2, conduit-like intake and pressure connections 7 and 8 are associated with housing cover 6 such that connections 7 and 8 are in fluid communication with suction chamber 9 and surge chamber 11, respectively, which are formed between housing cover 6 and control disk 5. Connections 7 and 8 may be molded or cast with housing cover 6 to form a single piece element. In any event, intake connection 7 introduces fluid directly into suction chamber 9, and fluid circulated into surge chamber 11 is discharged into pressure connection 8 via outlet opening 10 of the pressure connection. Cross bar or partition wall 12 extends along the inner surface of housing cover 6 between chambers 9 and 11 and abuts control disk 5, thereby delimiting suction chamber 9 and surge chamber 11 and preventing pressure leakage therebetween. In other words, control disk 5 and housing cover 6 together with cross bar 12 form suction chamber 9 and surge chamber 11. Cross bar 12 also may be molded or cast with housing cover 6 as a single piece element. Furthermore, a sealing element may be placed between cross bar 12 and control disk 5 to enhance the seal therebetween, and hence, the seal between chambers 9 and 11.

Control disk 5 has at least one inlet port 13 and at least one outlet port 14, 15, i.e., control disk 5 may have more than one intake and discharge opening or orifice formed therethrough. Inlet port 13, illustrated by a dotted line in FIG. 2, provides fluid communication between suction chamber 9 and at least one of the pockets or cells formed between adjacent blades on the impeller. The outlet port, which is subdivided into several outlet bores 14 and outlet slit 15, as illustrated by the dotted lines in the area of surge chamber 11, provides fluid communication between surge chamber 11 and at least one of the pockets or cells formed between adjacent impeller blades. In a well known manner, outlet bores 14 may be sealed by valves or covered by valve tongues.

Baffle 16 extends in the axial direction from inner side wall **6*a* of housing cover 6 adjacent outlet opening 10. Baffle 16 preferably is formed on wall 6*a*, and thus, may be molded or cast therewith. An additional baffle 17 is designed as a separate component and may comprise, for example, a flexible plastic strip. Baffle 17 is inserted in retention slits 19 and 20 provided in cross bar 12 and in retention bar 18 projecting beyond baffle 16 in the axial direction. Additional baffle 17 is expediently designed as a flexible plastic strip with its axial length being somewhat greater than the rectilinear distance between retention slits 19 and 20. Thus, plastic strip 17 which forms the additional baffle must be bent accordingly upon insertion into retention slits 19 and 20. The tension forces resulting from the bending action presses the lateral edges of the plastic strip against the surface areas of retention slits 19 and 20**, so that, as a result of the clamping effect, the plastic strip is retained in its position without additional fasteners.

Figure 1:
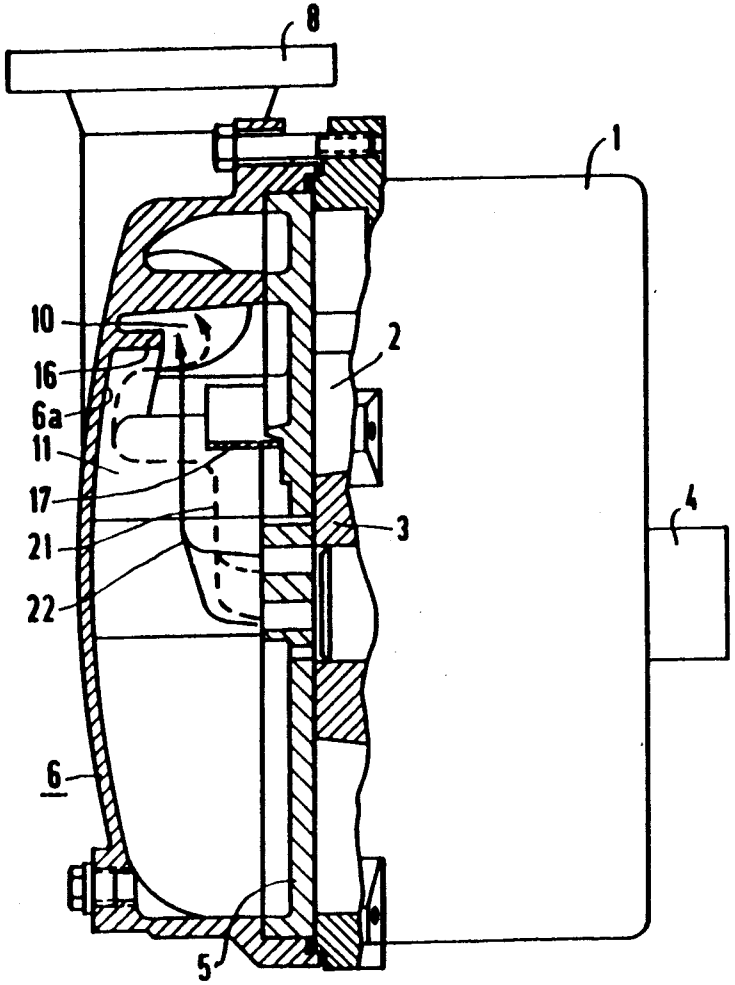
FIG. 1 is a partial longitudinal cross-sectional view of a liquid ring pump in accordance with the principles of the present invention.

During the operation of the liquid ring pump, together with the gas compressed in the blade cells, a portion of the sealing liquid also is expelled through outlet bores 14 and outlet slit 15. This gas-liquid mixture flows through surge chamber 11 toward outlet opening 10 of pressure connection 8. Before the mixture reaches outlet opening 10, it is first deflected by additional baffle 17 as baffle 17 is positioned radially inwardly of baffle 16. After the liquid particles have been deflected in an axial direction toward inside wall **6*a* of housing cover 6, they continue to flow in the axial direction, due to their mass inertia which is greater than that of the gas particles, until they are deflected by wall 6*a* in a radial direction toward baffle 16. Then, the liquid particles are deflected by baffle 16, again in the axial direction. Finally, after following this tortuous path, represented by the dotted line designated by arroW 21 (FIG. 1), the liquid particles flow through outlet opening 10 into pressure connection 8. Due to their smaller mass, the inertia of the gas particles is less than that of the liquid particles. Accordingly, the gas particles are deflected to a lesser degree as illustrated by the solid line designated by arrow 22 (FIG. 1). Since baffles 16 and 17 do not overlap in the axial direction, there is an axial gap therebetween which permits the gas particles to travel past baffles 16 and 17 toward outlet opening 10 along relatively rectilinear path 22**.

In view of the above description and the illustration of paths 21 and 22 in FIG. 1, it should be understood that the liquid particles cross the path of the gas particles. Thus, the veil of liquid particles between outlet bores 14 and outlet slit 15 of control disk 5 and outlet opening 10 of pressure connection 8 produces a damping layer. This damping layer greatly dampens any noise generated at outlet bores 14 and outlet slit 15. It also should be noted that these damping measures require only a minimum expenditure due to the simple construction of the damping mechanism. Furthermore, since the gas particles are only deflected to a small extent, no pressure losses of any consequence result.

What is claimed is:

1. A liquid ring pump comprising:

(a) a cup-shaped housing having an open end;

(b) an impeller rotatably supported in said cup-shaped housing, said impeller including blades, said blades spaced so that blade pockets are formed between adjacent blades to contain a certain amount of liquid;

(c) a cup-shaped member covering the open end of said housing, said cup-shaped member including an intake conduit having an inlet opening and a pressure conduit having an outlet opening, said openings providing fluid communication between said intake and pressure conduits and the interior of said cup-shaped member facing said housing, said cup-shaped member further including at least one wall extending toward said cup-shaped housing and being disposed between said inlet opening and outlet opening;

(d) a control disk arranged between said cup-shaped housing and said cup-shaped cover member, said control disk and said cup-shaped cover member together with said at least one wall forming a suction chamber in fluid communication with said intake conduit via said inlet opening and a surge chamber in fluid communication with said pressure conduit via said outlet opening, said control disk including at least one inlet port and at least one outlet port formed therethrough, said inlet port providing fluid communication between said suction chamber and at least one of said blade pockets and said outlet port providing fluid communication between at least one of said blade pockets and said surge chamber; and (e) means being disposed within said surge chamber between the outlet port of said control disk and the outlet opening of said pressure conduit for diverting fluid flowing in said surge chamber from said outlet port toward the outlet opening of said pressure conduit to follow a path in the axial direction, thereby diverting the portion of the sealing liquid, which is expelled with compressed gas into the surge chamber, to follow a path which intersects the path of the compressed gas, said diverting means comprising first and second radially spaced baffles that extend in the axial direction with respect to said cup-shaped member, said first and second baffles being arranged without overlap therebetween in said axial direction so that an axial gap is formed therebetween that provides a relatively straight unobstructed path extending between said baffles and toward said outlet opening.

2. The liquid ring pump of claim 1 wherein said said first baffle extends from said cup-shaped member and partially covers the outlet opening of said pressure conduit.

3. The liquid ring pump of claim 2 wherein said first baffle is integrally formed with said cup-shaped member.

4. The liquid ring pump of claim 2 wherein the cup-shaped member has an inner wall, one of said baffles being formed on said inner wall and the other baffle being releasably secured to the cup-shaped member.

5. The liquid ring pump of claim 4 wherein said cup-shaped member includes two retention slits extending in the axial direction of said cup-shaped member, said second baffle comprising a strip having two edges inserted into said retention slits.

6. The liquid ring pump of claim 6 wherein said second baffle is a flexible plastic strip, the distance along the surface of said strip between said edges being slightly greater than the rectilinear distance between said retention slits.

* * * * *